United States Patent [19]

Gojo et al.

[11] Patent Number: 4,695,834

[45] Date of Patent: Sep. 22, 1987

[54] PATTERNED LINE GENERATOR FOR A DATA PROCESSING DEVICE

[75] Inventors: Tomomi Gojo, Zama; Yoshio Yagi, Hatano; Tsunetada Izumi, Sagamihara, all of Japan

[73] Assignee: Ricoh Company, Ltd., Tokyo, Japan

[21] Appl. No.: 701,612

[22] Filed: Feb. 14, 1985

[30] Foreign Application Priority Data

Feb. 14, 1984 [JP] Japan ..... 59-25698

[51] Int. Cl.[4] ..... G09G 1/16

[52] U.S. Cl. ..... 340/734; 340/723; 340/745

[58] Field of Search ..... 340/734, 739, 720, 723, 340/721, 745

[56] References Cited

U.S. PATENT DOCUMENTS 4,291,305 9/1981 Kimura et al. ..... 340/734

4,295,135 10/1981 Sukonick ..... 340/734

4,524,353 6/1985 Chase ..... 340/739

4,584,573 4/1986 Ito ..... 340/734

*Primary Examiner*—Marshall M. Curtis

*Attorney, Agent, or Firm*—Oblon, Fisher, Spivak, McClelland, & Maier

[57] ABSTRACT

A data processing device for writing various kinds of rule data easily and rapidly in a pixel image memory. Rule pattern store means stores a plurality of kinds of rule patterns in the line direction and a plurality of kinds of rules in the digit direction, the line and digit directions respectively being associated with those of an image data store area of the pixel image memory. Means is provided for selecting one of the rule patterns stored in the rule pattern store means and moving it to the pixel image memory. In response to a command entered through an input device, desired one of the rule patterns is selected and only a desired length of the selected rule pattern is moved.

6 Claims, 11 Drawing Figures

| Fig. 8A | Fig. 8B |
|---|---|

| Fig.10A-1 | Fig.10A-2 |
|---|---|

Fig. 10A-2

#11 ADDRESS OF RULE START POINT a → DESTINATION REGISTER D

SHIFT n(=5) → SHIFT COUNTER n=5

00000 1111111111111 → WRITE MASK REGISTER n (WORD LENGTH-n) 00000111111111111 ···· ($D_1$)

#12 $26 \times 2 \times \frac{1}{16} = 3$ ····· RESIDUAL 4

→ TRANSFER COUNTER p=3

→ MASK REGISTER q=4

#13 START ADDRESS OF RULE PATTERN → SOURCE REGISTER S

#14 LOAD SOURCE ADDRESS REGISTER S DATA 1111000001111111 ···· ($D_2$)

n=5

RIGHT-SHIFT n=5 1111111110000011 ·· ($D_3$)

WRITE MASK REGISTER 00000111111111111 ··· ($D_1$)

($D_3 \wedge D_1$) xxxxx11110000011 ···· ($D_4$)

WRITE $D_4$ IN DESTINATION ADDRESS D

#15 D+1 → D

1111111110000011 ··· ($D_3$)

INVERTED D 11111000000000000 ·· ($D_1'$)

($D_3 \wedge D_1'$) 11111xxxxxxxxxxx ·· ($D_5$)

WRITE D IN DESTINATION ADDRESS D

#16 S+1 → S

INVERTED $D_1'$ 00000111111111111 ··· ($D_1$)

#17 C−1 → C

| Fig.10B-1 | Fig.10B-2 |
|---|---|

Fig. 10B-2

```
                                                  q
#18 MASK REGISTER q(=4)                           1111000000000000000···(D6)
    RIGHT-SHIFT BY n(=5) OF SHIFT COUNTER                ⇩
                                                  0000011111000000000···(D7)
                                                  0000011111111111111···(D1)
                                        (D7∧D1)   0000011111000000000···(D8)

#19 WRITE MASK REGISTER
    SET D8 ANEW IN WRITE MASK REGISTER

#20 SOURCE ADDRESS DATA                           11111111100000111···(D9)
    RIGHT-SHIFT BY n(=5) OF SHIFT COUNTER                ⇩
                                                  0011111111111 1000···(D10)
                                                  0000011111000000000···(D8)
                                        (D10∧D8)  xxxxx1111xxxxxxxx-(D11)
    WRITE D11 IN DESTINATION ADDRESS D

#21
        D + 1 ———→ D                              11111000001111111···(D8')
        INVERTED  D8                              0000011111000000000···(D7)
                                        (D8'∧D7)  0000000000000000000···(D12)
        SET D12 IN WRITE MASK REGISTER

#22                                               0011111111111111000···(D10)
                                                  0000000000000000000···(D12)
                                        (D10∧D12) xxxxxxxxxxxxxxxxx···(D13)
    WRITE D13 IN DESTINATION ADDRESS D
```

PATTERNED LINE GENERATOR FOR A DATA PROCESSING DEVICE

BACKGROUND OF THE INVENTION

The present invention relates to a data processing device with a pixel image memory which is suitable for use with an office or personal computer or a work processor each having a bit map display connected thereto or a laser beam printer or like image printer. More particularly, the present invention relates to a data processing device which allows various kinds of rules to be written in a pixel image memory rapidly and easily, thereby enhancing system processing performance.

A data processing device associated with a bit map display or an image printer, for example, usually includes a pixel image memory for processing data on a pixel basis. Written into the pixel image memory are graphs and other diagrams, characters, etc. The pixel image memory is addressed in terms of a word or a byte and, therefore, data need be written into the memory or read thereoutof on a word or byte basis. Such a processing system is more time-consuming than one which uses character codes. Concerning vertical and horizontal rules which often need be drawn, a prior art data processing device has customarily written line data in a pixel image memory by means of firmware. Even the prior art device uses a method which features a high-speed processing capability, so long as relatively simple lines such as solid lines are desired.

However, when it is desired to selectively draw many kinds of rules such as thin and thick solid lines, thin and thick dotted lines, thin and thick broken lines and thin and thick dash-and-dot lines as is often experienced with modern word processors and other data processing devices, the method in accordance with the prior art data processing device cannot be implemented without complicating the program and, moreover, without allocating a substantial period of time to processing for executing the program. Such undesirably lowers the processing performance of the system.

Specifically, it is preferably that such a pattern as a dotted line or a dash-and-dot line be positioned symmetrically in the lateral direction within a one-character write area in order to enhance attractive appearance, while the symmetrical position is unattainable unless an operation for shifting rule data is provided. To process data associated with various kinds of lines by use of the prior art device, an intricate control is required which would lower the system processing performance.

SUMMARY OF THE INVENTION

It is therefore an object of the present invention to provide a data processing device which eliminates the drawback encountered with the prior art device in processing rules as described above.

It is another object of the present invention to provide a data processing device which is capable of performing fast and easy processing for writing rule data associated with desired kinds of rules.

It is another object of the present invention to provide a data processing device which allows a dotted line, broken line, dash-and-dot line or any other similar line to be drawn symmetrically in one-character writing area, thereby enhancing the quality of such a rule.

It is another object of the present invention to provide a generally improved data processing device.

In one aspect of the present invention, there is provided a data processing device having an input unit, a pixel image memory and a control unit for drawing a particular line in the pixel image memory in response to a command entered through the input unit. The data processing device comprises a particular line pattern store for storing basic patterns representative of a plurality of kinds of particular lines extending in a line direction and a plurality of kinds of particular lines extending in a digit direction, the line and digit directions corresponding respectively to lines and digits of an image data store area of the pixel image memory, and a particular line pattern selecting and moving unit for selecting one of the basic patterns stored in the particular line pattern store and moving the selected basic pattern to the pixel image memory.

In another aspect of the present invention, there is provided a data processing device having an input unit, a pixel image memory and a control unit for drawing a particular rule in the pixel image memory in response to a command entered through the input unit. The data processing device comprises a particular rule pattern store for storing basic patterns representative of a plurality of kinds of particular rules extending in a line direction and a plurality of kinds of particular rules extending in a digit direction, the line and digit directions corresponding respectively to lines and digits of an image data store area of the pixel image memory, and a particular rule pattern selecting and moving unit for selecting one of the basic patterns stored in the particular rule pattern store and moving the selected basic pattern to the pixel image memory.

The above and other objects, features and advantages of the present invention will become more apparent from the following detailed description taken with the accompanying drawings.

DESCRIPTION OF THE PREFERRED EMBODIMENTS

While the data processing device of the present invention is susceptible of numerous physical embodiments, depending upon the environment and requirements of use, substantial numbers of the herein shown and described embodiments have been made, tested and used, and all have performed in an eminently satisfactory manner.

Figure 1:
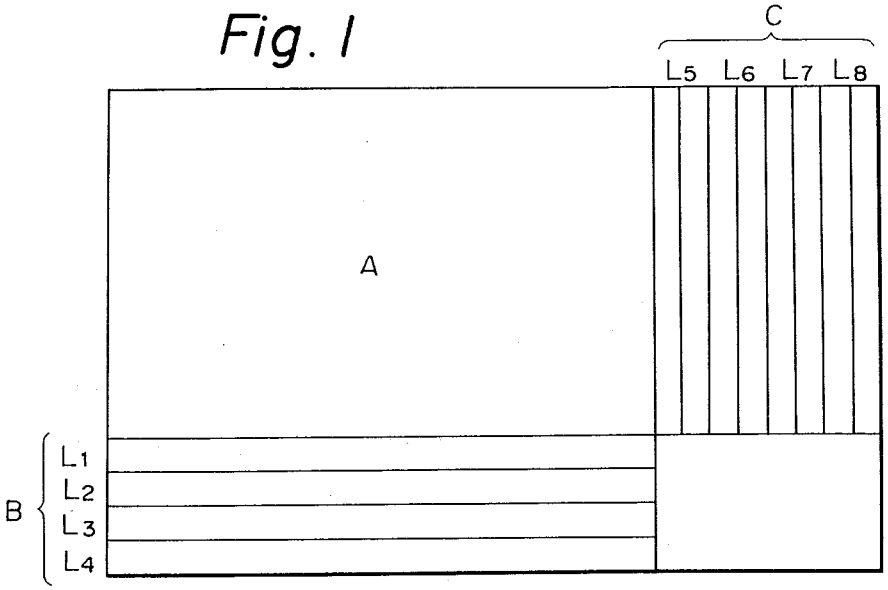
FIG. 1 shows a memory map representative of a one-frame or one-page pixel image memory for explaining the principles of the present invention.

Referring to FIG. 1 of the drawings, there is shown an exemplary construction of a one-frame or one-page pixel image memory for describing the principles of rule processing in accordance with the present invention. As shown, the pixel image memory includes an image data store area A, a horizontal rule data store area B, and a vertical rule data store area C. In the area B, horizontal rule data representative of a solid line, a dotted line, a broken line and a dash-and-dot line are stored in subareas $L_1$–$L_4$, respectively. Likewise, in the area C, vertical rule data representative of a solid line, a dotted line, a broken line and a dash-and-dot line are stored in subareas $L_5$–$L_8$, respectively.

Usually, a pixel image memory incorporated in a data processing device includes in a part thereof unused areas such as B and C in addition to the major image data store area. In FIG. 1, such unused areas are utilized for storing various kinds of rule data. Specifically, data representative of necessary kinds of horizontal rules in dot patterns are stored in the horizontal rule data store area B one line each. In the illustrative case, the data stored in the area B respectively are representative of a solid line $L_1$, a dotted line $L_2$, a broken line $L_3$ and a dash-and-dot line $L_4$. Likewise, data representative of necessary kinds of vertical rules in dot patterns are stored in the vertical rule data store area C one digit or column each, i.e. a solid line $L_5$, a dotted line $L_6$, a broken line $L_7$ and a dash-and-dot line $L_8$.

Figure 2:
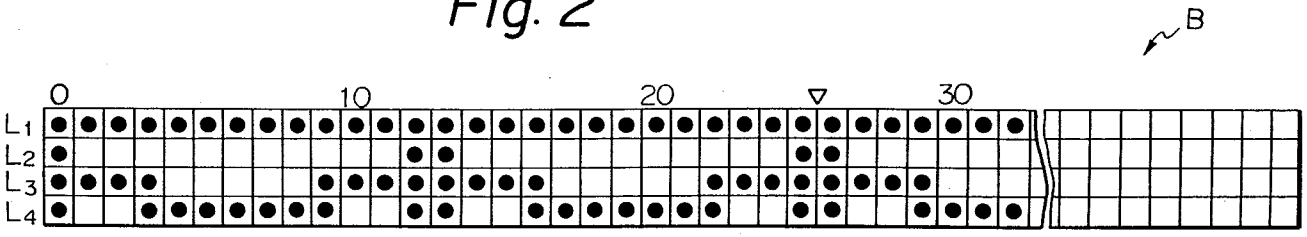
FIG. 2 is an enlarged view of a horizontal line data store area B shown in FIG. 1 which stores a group of exemplary basic dot patterns.

Referring to FIG. 2, basic dot patterns stored in the horizontal rule data store area B of FIG. 1 are shown in an enlarged scale. Labeled $L_1$–$L_4$ respectively are the subareas storing a solid line, a dotted line, a phantom line and a dash-and-dot line, as in FIG. 1. Bits marked with dots in FIG. 2 represent each one dot of rule pattern data, while blank bits represent space data associated therewith. The illustrative rule patterns apply to a case wherein one character pitch consists of twenty-six dots, a downwardly directed triangle marking the boundary between adjacent sets of twenty-six dots.

Figure 3:
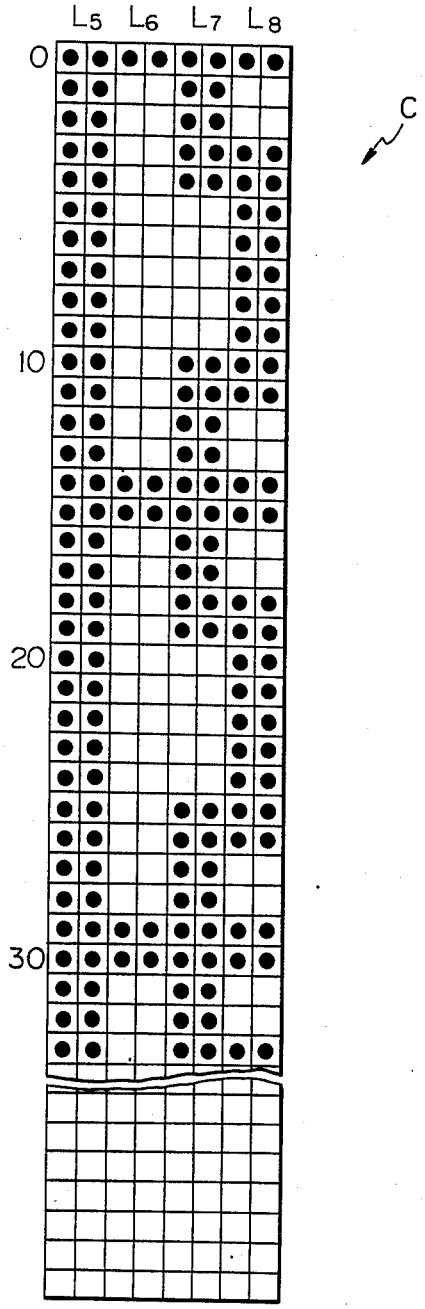
FIG. 3 is an enlarged view of a vertical line data store area C also shown in FIG. 1 which stores a group of exemplary basic dot patterns.

Basic dot patterns which may be stored in the vertical rule data store area C are shown in FIG. 3 in an enlarged scale. The markings shown in FIG. 3 are the same in significance as those shown in FIG. 2 and $L_5$–$L_8$, as in FIG. 1, represent a solid line, a botted line, a broken line and a dash-and-dot line, respectively. The basic dot patterns of FIG. 3 apply to a case wherein one line pitch consists of thirty dots.

As shown in FIG. 2, each of the basic dot patterns in the horizontal rule data store area B is designed such that it is symmetrical in the right-and-left direction within the range of one character pitch, i.e. twenty-six dots. Likewise, each of the basic dot patterns in the vertical rule data store area C is predetermined such that is is symmetrical in the up-and-down direction within the range of one line pitch, i.e. thirty dots.

Figure 4:
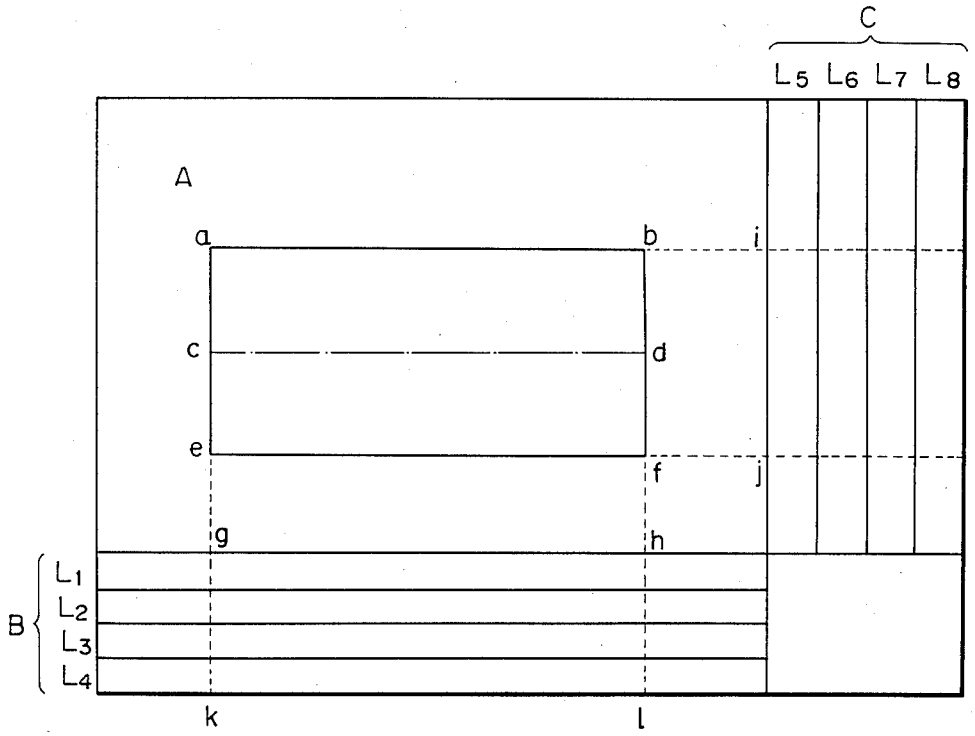
FIG. 4 shows the pixel image memory of FIG. 1 having an image data memory area A in which vertical and horizontal rules have been drawn.

Referring to FIG. 4, the image data store area A in the pixel image memory of FIG. 1 is shown with horizontal and vertical rules drawn therein. Characters a to f in FIG. 4 show start and end points of the rules, while characters g to l show start and end points in the horizontal rule data store area B and vertical rule data store area C.

To draw a thin rule from the point a to the point b in the image data store area A of FIG. 4, the solid line pattern data between the points g and h is moved from the subarea $L_1$ of the horizontal rule data store area B shown in FIGS. 1 and 2 to the extension defined between the points a and b in the area A. In the same manner, to draw a thin dash-and-dot line from the point c to the point d, the dash-and-dot line pattern data between the points k and l is moved from the subarea $L_4$ to the extension defined between the points c and d in the area A. The same principle applies to a thin rule between the points e and f, that is, it is drawn by moving the solid line data between the points g and h from the subarea $L_1$ to the extension between the points e and f in the area A.

It is assumed therein that the dot position of the point g in the subarea $L_1$ of the area B, that of the point k in the subarea $L_4$, and the like in the horizontal direction are aligned with the points a, c and e in the area A. Likewise, the dot position of the point h in the subarea $L_1$, that of the point l in the subarea $L_4$, and the like in the horizontal direction are assumed to be aligned with the points b, d and f in the area A.

In accordance with the present invention, even a horizontal thick rule such as a thick solid line or a thick dotted line can be drawn by writing the same thin solid line or dotted line or the like twice in positions which are shifted one dot vertically from each other in the image data store area A.

The vertical rules a–e and b–f shown in FIG. 4 will be written in the image data store area A as follows:

First, to draw a thin vertical rule from the point a to e in the area A, the solid line pattern data between the points i and j is moved from the subarea $L_5$ of the vertical line data store area C shown in FIGS. 1 and 3 to the extension between the points a and e as shown in FIG. 4. Concerning the vertical rules, four different kinds of vertical line patterns are stored in one byte in the area C as described and, in addition, the bit position in one word to draw a rule differs from one bit to another. For this reason, bit-masking is required in drawing a vertical rule so that the bit position in the subarea $L_5$ may be shifted to the desired position to write only that bit in the pixel image memory with the other bits prevented from being done so.

Likewise, a thin solid line extending from the point b to the point f in the image data memory area A may be written as a vertical rule by moving the rule data between the points i and j in the subarea $L_5$ of the area C to the extension between the points b and f in the area A as shown in FIG. 4. Again, the dot position of the point i in the subarea $L_5$ in the vertical direction is assumed to be in alignment with the points a and b in the area A, and the dot position of the point j in alignment with the points e and f.

As described above, the device of the present invention allows one to write any desired kind of rule data easily and rapidly into a pixel image memory merely by selecting one of the basic rule data stored in the subareas $L_5$–$L_8$ of the C which is associated with the desired pattern, then specifying two vertically aligned points, and then moving the selected basic rule data to the extension between the two points. As to the basic patterns representative of vertical rules, where one byte accommodates dot patterns representative of four different kinds of rules, two bits can be allocated to each kind of dot pattern and, therefore, it is possible to store even the data representative of a thick solid line and a thick dotted line. In that case, a thin solid or dotted line will be drawn by moving only one of the paired two bits, and a thick solid line or the like by moving the paired two bits together.

Figure 5:
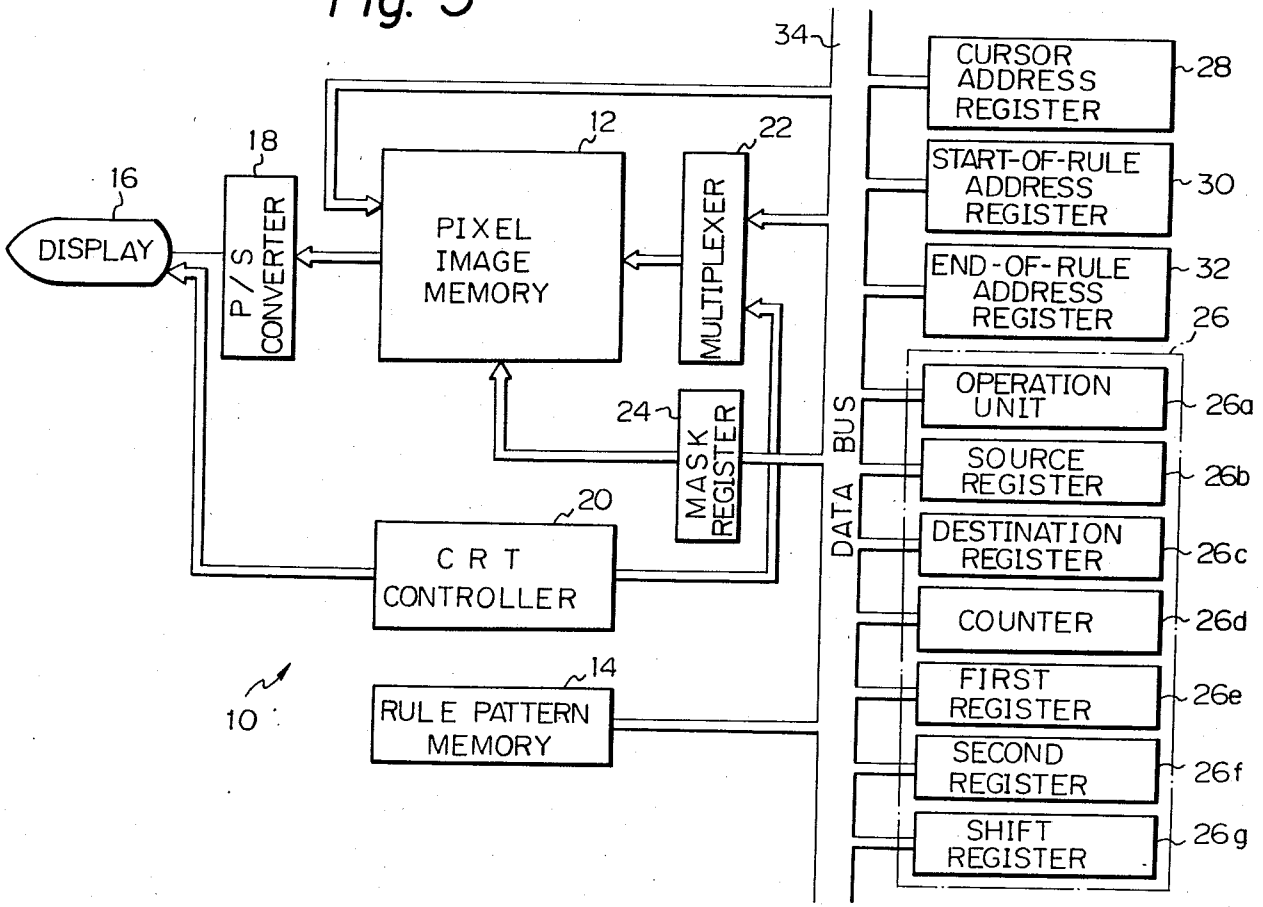
FIG. 5 is a functional block diagram of a data processing device embodying the present invention.

Referring to FIG. 5, a data processing device embodying the present invention is shown in a functional block diagram. The device, generally 10, includes a micro-CPU made up of a pixel image memory 12, a rule pattern memory 14, a display 16, a parallel-to-serial (P/S) converter 18, a CRT controller 20, a multiplexer 22, a mask register 24, an operation unit 26*a*, a source register 26*b*, a destination register 26*c*, a counter 26*d*, a first register 26*e*, a second register 26*f*, and a shift register 26*g*. The device 10 also includes a cursor address register 28, a start-of-rule address register 30, an end-of-rule address register 32, and a data bus 34.

In the illustrative embodiment, the rule pattern memory 14 storing various basic patterns representative of vertical and horizontal rules is independent of the pixel image memory 12 and adapted to store such rule pattern data as those shown in FIGS. 2 and 3. However, as mentioned earlier with reference to FIGS. 1–4, the memory 14 may be implemented by a part of unused areas of the pixel image memory 12. The source register 26*b* is adapted to store the start address (g, i or k in FIG. 4) of any of the rules which are stored in the data store areas (B of FIG. 2 or C of FIG. 3) of the rule pattern memory 14. The destination register 26*c* serves to store the start address of any of the rules to be drawn in the pixel image memory 12, i.e. points a, c, or e. The counter 26*d* functions to count bytes (or words) necessary for writing in accordance with a length of a vertical or horizontal rule.

Assuming that one character consists of twenty-six dots, that is, one character is twenty-four dots wide and the spacing between digits is two dots wide, it is desirable that a dash-and-dot line or a dotted line be drawn symmetrically within the body size (twenty-six dots) in the right-and-left direction. Such is fullfiled in accordance with the present invention by the source register 26*b* and destination register 26*c*. The start addresses of any of the various kinds of rule patterns is stored in the source register 26*b*, while selected one of the basic pattern data associated with that address is written in an address of the distination register 26*c*, whereby an attractive rule is drawn. In short, in contrast to the prior art device which has required bit shifting, what is required of the device of the present invention shown in FIG. 5 is simply moving rule pattern data.

Figure 6:
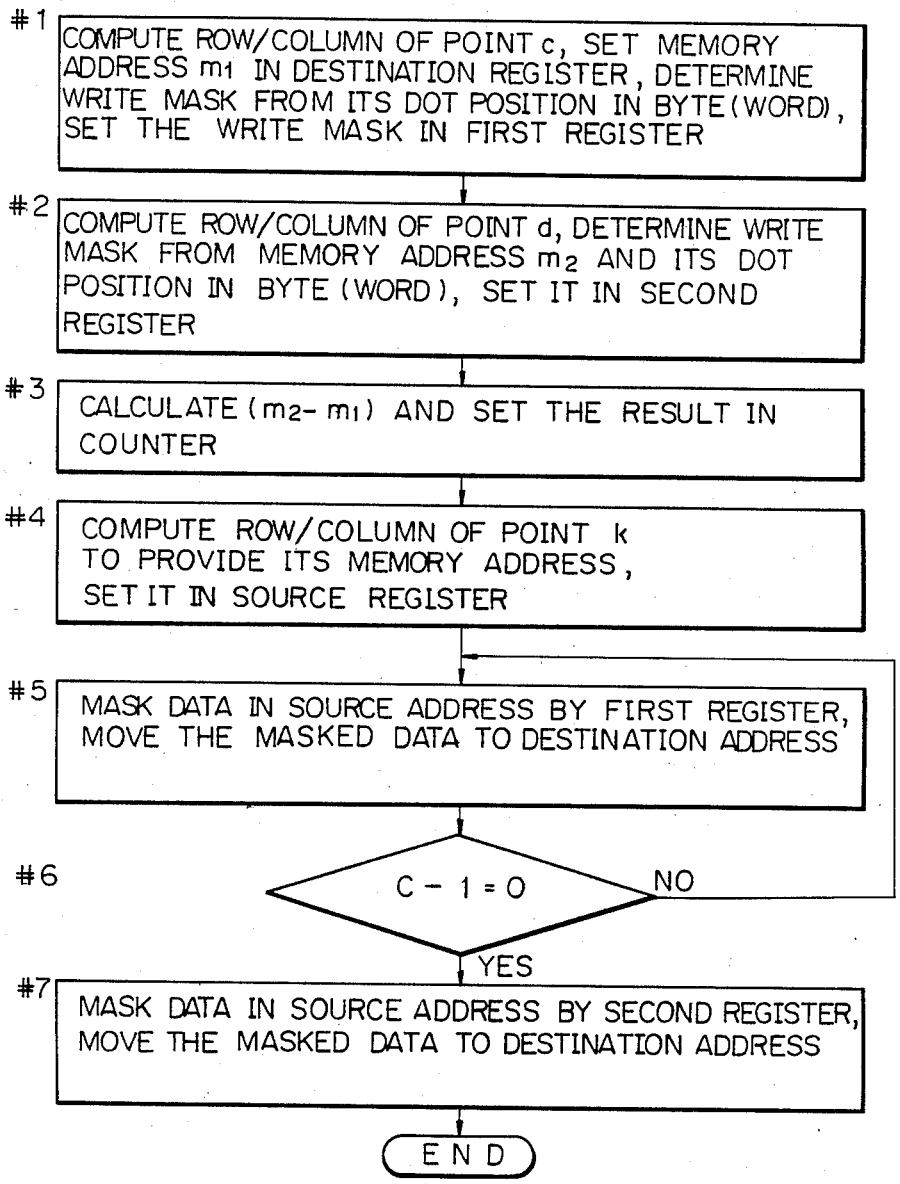
FIG. 6 is a flowchart representative of the operation of the device shown in FIG. 5 for drawing a dash-and-dot line by way of example.

Referring to FIG. 6, there is shown a flowchart which demonstrates exemplary steps of drawing a dash-and-dot line using the device 10 of FIG. 5 #1 to #7 in the drawing indicate individual steps. It should be born in mind that while the movement of line data described above with reference to FIG. 4 may be implemented by either one of hardware and software, it is accomplished by means of firmware in the flowchart of FIG. 6. The operation will be described on the assumption that a dash-and-dot line is to be drawn from the point c to the point d in the image data memory area A of the pixel image memory.

In FIG. 6, at step #1, the row/column of the point c specified by a cursor is computed, a memory address $m_1$ of the point c in the pixel image memory 12 (same as the point c of FIG. 4) is set in the destination register 26*c*, and a write mask is selected based on a dot position of the memory address $m_1$ in a byte (or word) and set in the first register 26*e*. Then, at step #2, the row/column of the other point d is computed, and a write mask is selected based on a memory address $m_2$ of the point d in the memory 12 and a dot position thereof in a byte (or word) and set in the second register 26*f*. At the next step #3, a difference, $m_1-m_2$, is calculated and the result C is set in the counter 26*d*. The difference C represents a number of bytes (or words) corresponding to the distance between the points c and d of the rule.

At step #4, the row/column of the point k is computed to determine a memory address of the point k (same as the point k of FIG. 4) in the rule pattern memory 14, the determined memory address being applied to the source register 26*b*. At the subsequent step #5, pattern data associated with the dash-and-dot line is read out of the address of the point k residing in the source register 26*b* and, with a mask set by the first register 26*e*, the pattern data is moved to the address of the point c in the memory 12 which has been set in the destination register 26*c*. These consecutive steps are repeated over to the last byte (or word). At step #6, in order to see if the current byte (word) is the last byte (word) in terms of the difference C indicated by the counter 26*d*, whether C−1 is equal to "0" is determined.

If C−1 is not equal to "0", the source register 26*b* and destination register 26*c* are each incremented by one and, then, the operation returns to the step #5 so that pattern data addressed by the source register 26*b* is moved to an address which is specified by the destination register 26*c*. On the other hand, if C−1 is found equal to "0" at the step #6, that is, if the byte (word) is the last one, the operation advances to step #7 at which pattern data addressed by the source register 26*b* is written into an address designated by the destination register 26*c* with a mask set by the second register 26*f*. As a result, a dash-and-dot line is drawn from the point c to the point d in the pixel image memory 12.

Thus, with the device 10 shown and described, one needs only to select a desired kind of rule data and move it over its length. Such will prove specially effective in case where the number of horizontally arranged dots which constitute one character is not byte-boundary (or word-boundary) with respect to the pixel image memory.

Figure 7:
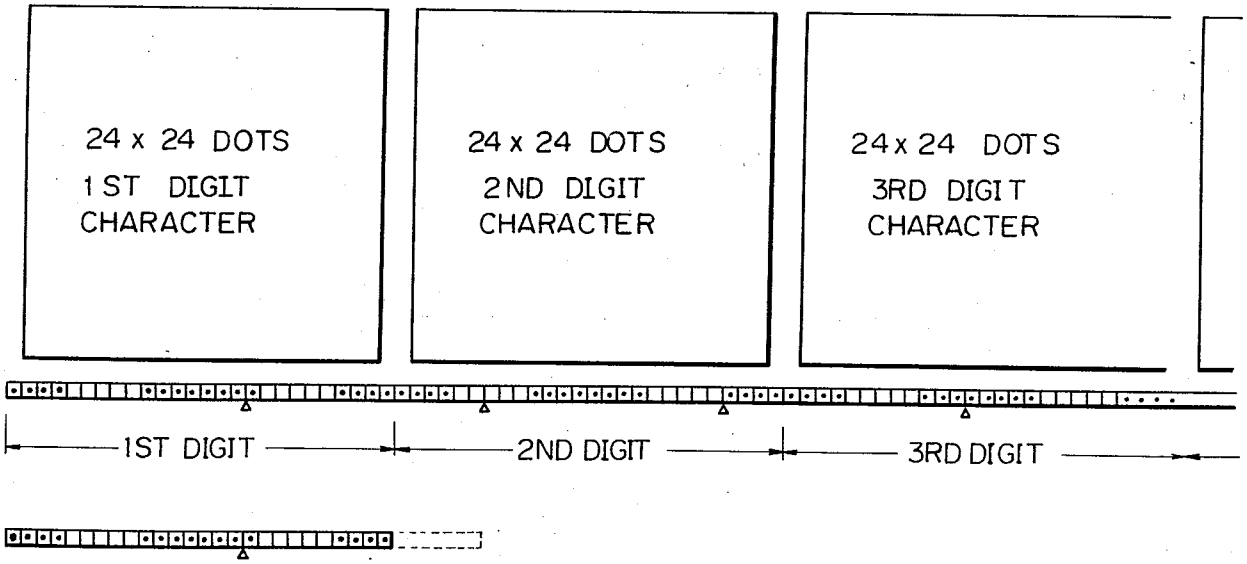
FIG. 7 shows exemplary correspondence between a rule pattern drawn in a pixel image memory and broken line data stored in a horizontal rule data store area of a rule pattern memory for illustrating a broken line write operation in accordance with the data processing device of the present invention.

Referring to FIG. 7, there is shown an exemplary correspondence between a rule pattern drawn in the pixel image memory 12 and broken line data stored in the horizontal rule data store area of the line pattern memory 14 for describing a dotted line write operation of the device of the present invention. Upwardly directed triangles in FIG. 7 are boundary marks between words. In FIG. 7, as has been the case with FIG. 4, one character is assumed to comprise twenty-six dots twenty-four of which define a character width and the other two, an interdigit spacing. Data stored in the horizontal rule data store area and representative of a broken line is positioned in advance in such a manner as to be symmetrical in the right-and-left direction over the range of the horizontal twenty-six dots, or one character, as shown in a lower part of FIG. 7. The rule pattern shown in an upper part of FIG. 7 will be written into the pixel image memory by the same procedure as the flowchart of FIG. 6.

Specifically, to draw the basic pattern shown in the lower part of FIG. 7, i.e. dot pattern representative of a broken line, into the first digit, all that is needed is specifying an address which corresponds to the point k. To write a rule into the second digit, on the other hand, the prior art device has to shift the bits by ten bits (26 dots−16 dots=10 dots) in the pixel image memory. As to the third bit, too, the prior art device has to shift the bits by four bits (26×2 dots−16×3 dots=4 dots). In contrast, the device 10 of the present invention is capable of drawing rules even in the second and third digits each in a symmetrical position without resorting to such bit shifts, that is, merely by moving line data such as one shown in the lower part of FIG. 7.

Figures 8, 8A:
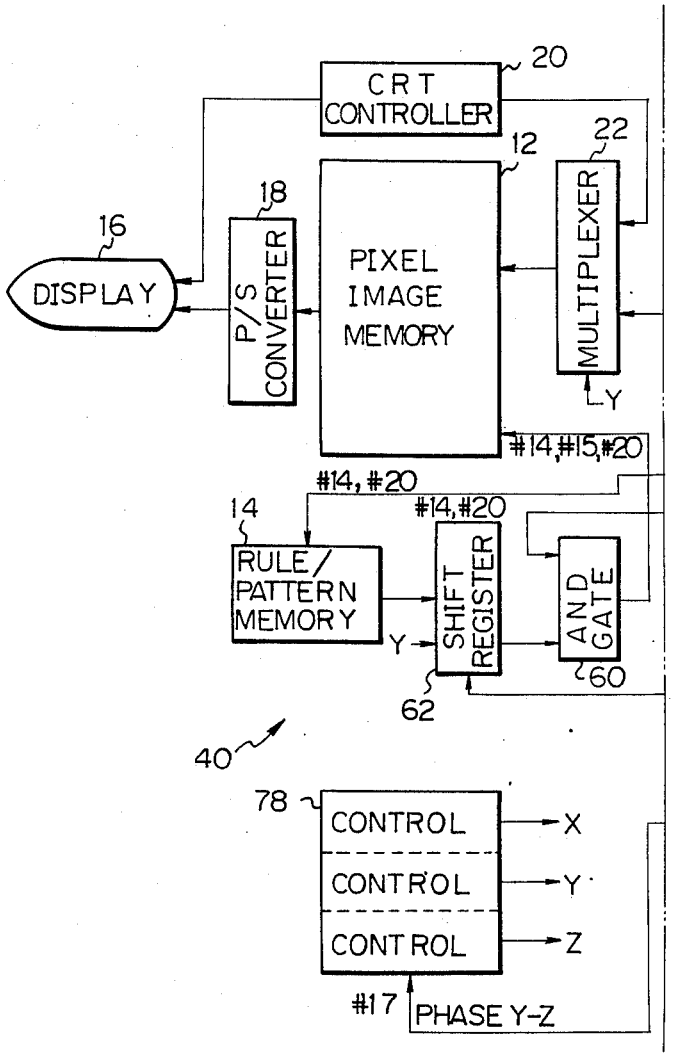
FIG. 8 is a functional block diagram of another embodiment of the present invention.
Figure 8B:
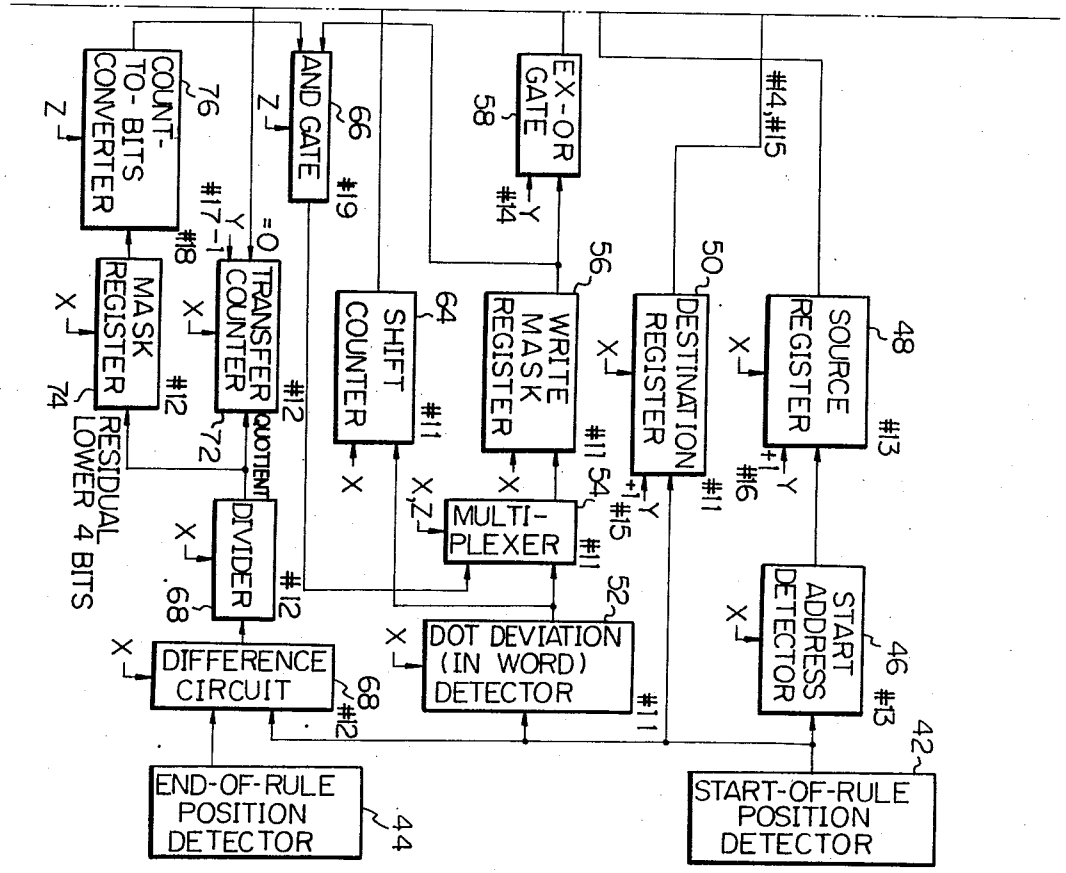

Referring to FIG. 8, another embodiment of the present invention is shown and generally designated by the reference numeral 40. In FIG. 8, the same structural elements as those shown in FIG. 5 are designated by like reference numerals. The device 40 includes a detector 42 responsive to a start-of-rule position indicated by a cursor, a detector 44 responsive to an end-of-rule position also indicated by the cursor, a detector 46 responsive to a start address of the rule pattern memory 14, a source register (counter) 48, a destination register (counter) 50, a detector 52 responsive to a dot deviation in a word at the start position, a second multiplexer 54, a write mask register 56, an Exclusive-OR (EX-OR) gate 58, a first AND gate 60, a shift register 62, a shift counter 64, a second AND gate 66, a difference compute (computation of an amount of movement of a rule pattern) circuit 68, a divider 70, a counter 72 responsive to an amount of transfer, a mask register 74, a count-to-bits converter 76, and a control circuit 78. Labeled #11 to #22 are individual operating steps and X to Z, points of connection corresponding to each other.

The device 40 of FIG. 8, unlike the device of FIG. 5, is constructed to allow broken lines, dash-and-dot lines and other similar lines to be drawn each symmetrically in the right-and-left direction over the range of one character even when the positions of characters are are free to choose in the pixel image memory 12, thereby providing high quality rule patterns.

Figure 9:
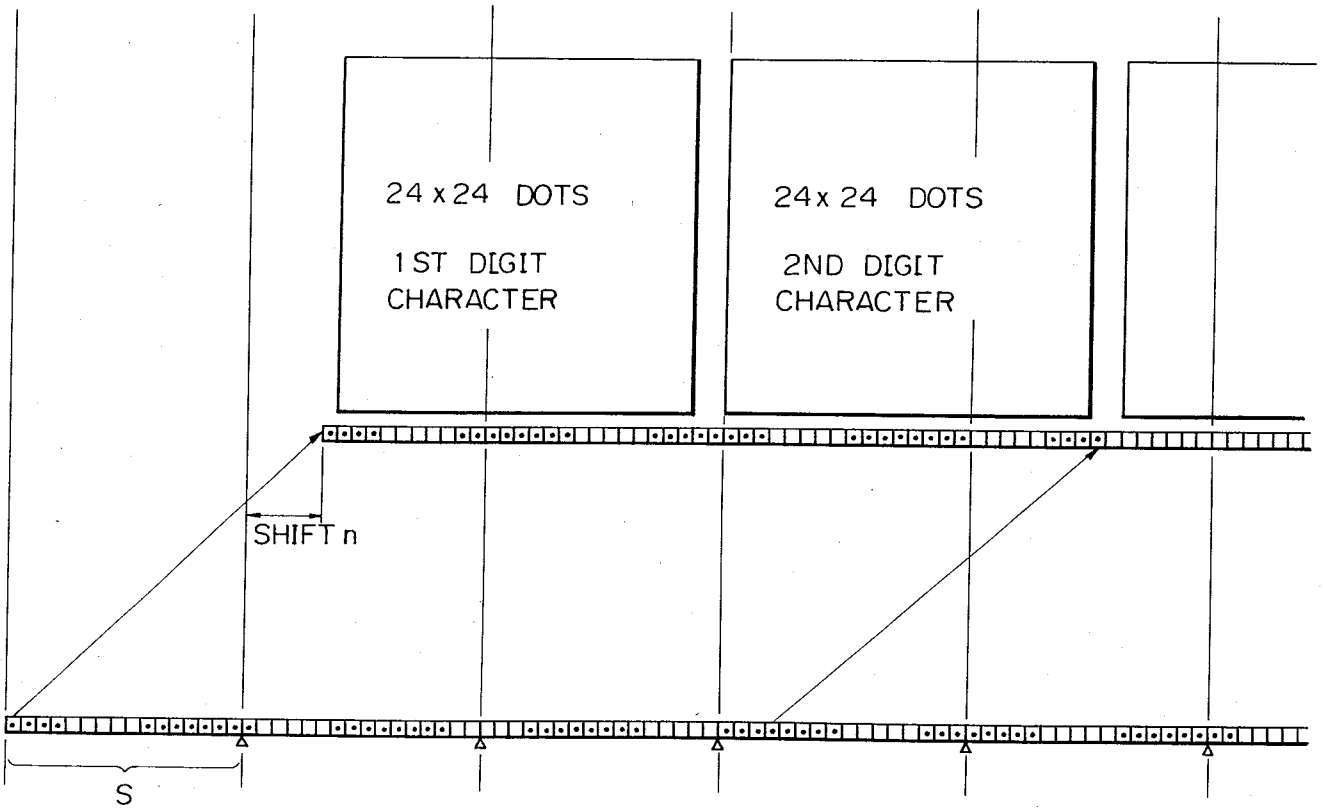
FIG. 9 shows a broken line pattern drawn in a pixel image memory and broken line data stored in the horizontal line data store area of the line pattern memory for describing a broken line write operation in accordance with the data processing device of the present invention.

Referring to FIG. 9, there is shown an example of broken line data stored in the horizontal rule data store area of the rule pattern memory 14 and a broken line drawn in the pixel image memory 12 for describing an operation of the device of the present invention for writing a broken line. In FIG. 9, n indicates a deviation, or shift, of a dot position from a boundary of words in the pixel image memory 12, S a start address of broken line data stored in the horizontal rule data store area of the rule pattern memory 14, and an upwardly directed triangle a boundary of words in the pixel image memory 12 and in the broken line data. FIG. 9 is the same as FIG. 7 in that one character consists of twenty-six dots, that is, twenty-four dots assigned to a character width and two dots assigned to an interdigit spacing, but differs therefrom in that in FIG. 9 the character write position is free to choose.

In this case, too, a dot pattern representative of a dash-and-dot line or a dotted line can be written into the pixel image memory 12 symmetrically within the body size (twenty-six dots). In FIG. 9, the basic rule pattern stored in the rule pattern memory 14 and the respective dots of the rule drawn in the memory 12 on the basis of the basic rule pattern are presented in a single drawing in order to facilitate understanding of their correspondence. However, as repeatedly mentioned, the memories 12 and 14 need not always be the same memory and may be implemented by independent memories.

Figures 1, 10A:
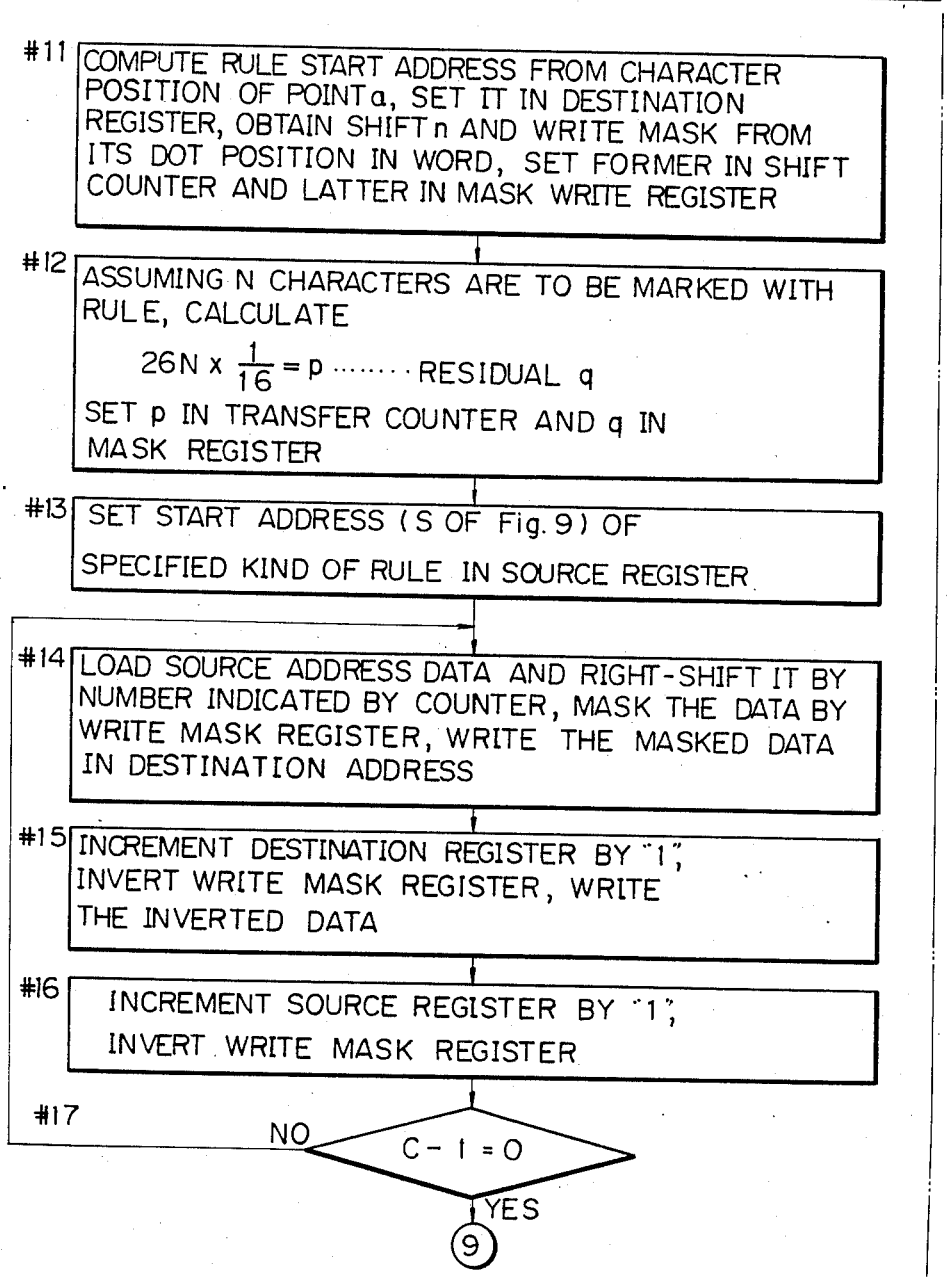
FIGS. 10A and 10B show in detail a relationship between a flowchart representative of the operation the device of FIG. 8 for drawing a broken line as a horizontal line as shown in FIG. 9 and data stored in various blocks of FIG. 8 during the operation as demonstrated by the flowchart.
Figures 1, 10B:
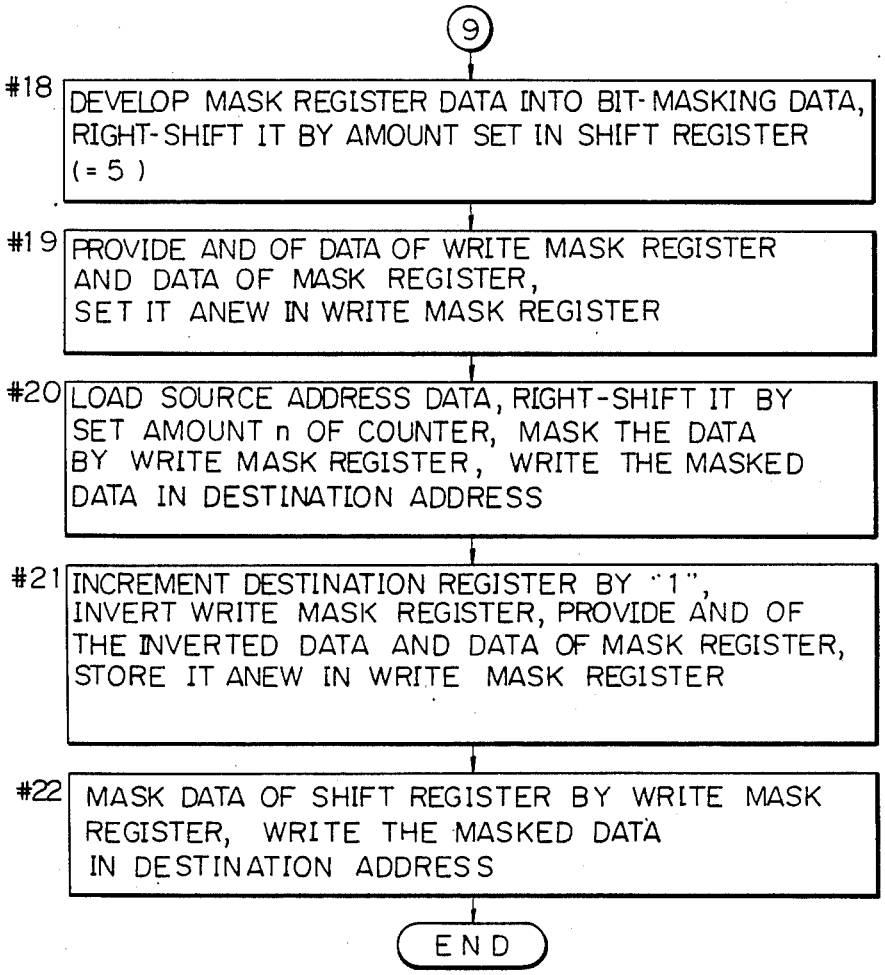

Referring to FIGS. 10A and 10B, there is shown in detail a relationship between an exemplary flowchart representative of the operation for drawing such a horizontal broken line as one shown in FIG. 9 and data which will be stored in various blocks of FIG. 8 in accordance with the flowchart. Labeled #11 to #22 in FIGS. 10A and 10B are a series of steps corresponding respectively to the step positions of FIG. 8 which are designated by the same labels. Circled 9's in FIGS. 10A and 10B indicate points of connection.

The operation shown in FIGS. 10A and 10B, like the operation described with reference to FIG. 4, is to draw a broken line from the point a (c or e) to the point b (d or f) in the image data store area of the memory 12. The number N of characters over which the broken line is to be drawn is assumed to be two and the shift n, five.

First, at step #11 of FIG. 10A, the start-of-rule position detector 42 shown in FIG. 8 computes a start address D of the rule in the pixel image memory 12 based on the start position of a character designed by a cursor (point a of FIG. 4). The computed start address is set in the destination register 50. The dot deviation detector 52 determines a shift n and a write mask based on a dot position within a word at the start position. The shift n is set in the shift counter 64, while the mask data is set in the write mask register 56. At this stage, therefore, the start address of the rule has been set in the destination register 50 of FIG. 8 and the shift n in the shift counter 64, as shown in a right part of FIG. 10A. Here, the numerical value stored in the shift counter 64 is "5" because n is five. Loaded in the write mask register 56 is right mask data $D_1$ which is "0000011111111111".

At the next step #12, a shift q is computed. For example, assuming that N characters are to be marked with a line, the following operation is performed:

$$26N \times 1/16 = p$$

residual . . . q

The quotient p is set in the transfer counter 72 and the residual q in the mask register 74. Here, "26" is the number of dots associated with the character pitch and "16", the number of dots within a word. Since the number of characters N in this embodiment is two, the quotient p is "3" and the residual q is "4" and, hence, data "3" is set in the transfer counter 72 while data "4" is set in the mask register 74.

Subsequently, at step #13, a start address S (same as S of FIG. 9) of the rule pattern memory 14 which has stored the specified kind of rule is loaded in the source register 48. At step #14, pattern data $D_2$ at the address S is loaded in the shift register 62 based on the data S residing in the source register 48, i.e. start address S of the rule pattern memory 14. Then, the shift register 62 suquentially shift-writes (loops) a number of times equal to n=5, which has been set in the shift counter 64, thereby preparing data $D_3$. The data $D_3$ is masked by the data $D_1$ provided b the write mask register 56, whereafter the resulting data $D_4$ is written into the address D specified by the destination register 50.

Since the kind of rule desired in this case is a broken line, the shift register 62 is loaded with pattern data "1111000001111111" of the first word from the rule pattern memory 14 as the data $D_2$, as shown in a right part of FIG. 10A. In the shift register 62, the data $D_2$ is shifted n=5 times to provide the data $D_3$. The data $D_3$ is applied to the first AND gate 60 together with the data $D_1$ output from the write mask register 56. An output of the AND gate 60 is written into the destination address D of the pixel image memory 12 as data $D_4$. In FIG. 10A, those bits of the data $D_4$ marked "x" represent the bits which are not written.

At step #15, the data D in the destination register is incremented while the data in the write mask register 56 is inverted and written into the address that has been specified by the destination register 50. That is, as shown in the right part of FIG. 10A, the data $D_3$ loaded in the shift register 62 and the inverted version $D'_1$ of the data $D_1$ in the write mask register 56 are applied to the first AND gate 60 to produce data $D_5$ which is then written into the destination address D. Again, the mark "x" represents the bits which are not written. By the steps #14 and 15 as described so far, writing of the first one word of data stored in the rule pattern memory 14 is completed.

Then, at step #16, the data S in the source register 48 is incremented and the data $D_1$ in the right mask register 56 is inverted to provide inverted data $D'_1$. Under this condition, the data in the write mask register 56 is returned to the data $D_1$, as shown in the right part of FIG. 10A.

At the subsequent step #17, whether C−1 is equal to "0" is determined and, if not, the operation returns to the step #14. In this example, C−1→C is 3−1=2→C. This step #17 is to see if the number of words to be provided with a rule and not done so yet is one. If it is two or more, then the operation returns to the step #14 to go through the steps #14–16 again. If C−1 is equal to "0", on the other hand, meaning that only one word has been left without a line, the operation advances from the circled 9 of FIG. 10A to that of FIG. 10B, i.e. Step #18. At this step, the data residing in the mask register 74 is developed into bit-masking data $D_6$ which is then right-shifted (looped) by the number n(=5) which has been set in the counter 64. In this condition, as shown in the right part of FIGS. 10B, the data q=4 in the mask register 74 is developed into the data $D_6$ by the count-to-bits converter 76 and, then, shifted n(=4) times as is the data set in the shift counter 64, whereby data $D_7$ is prepared.

At step #19, the data $D_1$ in the write mask register 56 and the data $D_7$ prepared by the mask register 74 and count-to-bits converter 76 are coupled to the second AND gate 66 an output of which, data $D_8$, is newly set in the write mask register 20. In this condition, as shown in the right part of FIG. 10B, the count-to-bits converter 76 produces the data $D_7$, and AND of the data $D_7$ and the data $D_1$ in the write mask register 56 is provided to be set in the right mask register 56 again.

At step #20, pattern data $D_9$ from the line pattern memory 14 which is associated with the address S is loaded in the shift register 62 in response to the data S in the source register 48 and, then, sequentially right-shifted (looped) by the number n=5 indicated by the shift counter 64. The resulting data, $D_{10}$, is masked by the write mask register 56 and, then, written into an address designated by the data D stored in the destination register 50. Under this condition, as shown in the right part of FIG. 10B, the pattern data $D_9$ addressed by the data S in the source register 48 and loaded in the shift register 62 is "1111111100000111" which is at the fourth word as shown in the lower part of FIG. 9. Due to n=5 times of shifting of the data $D_9$, data $D_{10}$ is set in the shift register 62. Further, since the data $D_8$ has been set in the write mask register 56, AND of the data $D_{10}$ and $D_8$ provides data $D_{11}$ which is then written into the destination address D. Those bits of the data $D_{11}$ which are marked "x" are not written.

At step #21, the data D in the destination register 50 is incremented and the data in the write mask register 56 is inverted. The second AND gate 66 provides AND of the inverted data and the data stored in the mask register 74 and sets it newly in the right mask register 56. In this case, as shown in the right part of FIG. 10B, the data $D_8$ in the write mask register 56 is inverted to produce data $D'_8$ and AND of this data $D'_8$ and the data $D_7$ prepared by the mask register 74 and count-to-bits converter 76 is provided. Hence, the output of the AND gate 66 is data $D_{12}$ and the write mask register 56 is updated therewith.

At step #22, the data $D_{10}$ stored in the shift register 62 is masked by the write mask register 56 and, then, written into the destination address D. In this condition, as shown in the right part of FIG. 10B, the data $D_{10}$ has been set in the shift register 62. The data $D_{10}$ and the data $D_{12}$ which is stored in the write mask register 56 are routed to the first AND gate 60 to produce data $D_{13}$, the data $D_{13}$ being written into the destination address D of the pixel image memory 12. The bits with the mark "x" are not written and, in this case, all the bits are not written.

By the operation described above, a broken line is drawn which spans two characters in the pixel image memory 12 as shown in FIG. 9.

In this manner, whether character positions in the pixel image memory 12 be fixed or variable as desired, the data processing device in accordance with the second embodiment is capable of operating satisfactorily.

While the embodiments of the present invention have been shown and described taken rules for example, it will be apparent to those skilled in the art that the present invention is similarly applicable to underlines, shading and others and such is also within the scope of the present invention.

In summary, the present invention provides a data processing device which allows data associated with any one of various kinds of rules to be written in an image memory easily and rapidly, thereby remarkably enhancing the system processing performance. Especially, concerning a dotted line, broken line, dash-and-dot line or the like, it can readily be drawn in a laterally symmetical position over the range of one character of write area and, thus, attains high quality. That is, the device of the present invention is useful not only when positions of characters in a pixel image memory are fixed but also when they are free to choose as desired and, hence, it is preferable for use with a bit map display, an image printer or the like. In addition, the device of the present invention features a simple and, therefore, costcutting construction.

Various modifications will become possible for those skilled in the art after receiving the teachings of the present disclosure without departing from the scope thereof.

What is claimed is:

1. A data processing device having input means, pixel image memory means for storing data corresponding to data to be displayed and control means for storing a particular line in the pixel image memory means in response to a command entered through the imput means, said data processing device comprising:

particular line pattern store means for storing basic patterns representative of a plurality of particular lines extending in a first direction and a plurality of particular lines extending in a second direction, the first and second directions corresponding respectively to vertical and horizontal directions of an image data store area of the pixel image memory means;

particular line pattern transfer means including pattern selecting means for selecting one of the basic patterns stored in said particular line pattern store means and including moving means for moving the selected basic pattern from said particular line pattern store means to the pixel image memory means; and position control means for positioning said selected pattern by storing the start address of the selected pattern, storing the start address of the line to be drawn in the pixel image memory means and causing the selected pattern to be moved into the pixel image memory means at sequential memory positions contiguous with the start address in memory.

2. A data processing device as claimed in claim 1, wherein the particular line pattern store means comprises an otherwise unused area of the pixel image memory means.

3. A data processing device as claimed in claim 1, wherein the lines comprise at least one of a dotted line, a broken line and a dash-and-dot line.

4. A data processing device as claimed in claim 3, wherein the position control means shifts the selected line pattern to a position which is symmetrical in a lateral direction corresponding to a character in the image data store area of the pixel image memory means.

5. A data processing device as claimed in claim 4, wherein the line position control means comprises a source register for storing the start address of the selected line in a store area of the rule pattern store means and a destination register for storing the start address of the line to be drawn in the pixel image memory means.

6. A data processing device having input means, pixel image memory means for storing data corresponding to data to be displayed and control means for storing a particular rule line in the pixel image memory means in response to a command entered through the input means, said data processing device comprising:

particular rule line pattern store means for storing basic patterns representative of a plurality of particular rule lines extending in a first direction and a plurality of particular rule lines extending in a second direction, the first and second directions corresponding respectively to vertical and horizontal directions of an image data store area of the pixel image memory means;

particular rule line pattern transfer means including pattern selecting means for selecting one of the basic patterns stored in said particular rule line pattern store means and including moving means for moving the selected basic pattern from said particular rule line pattern store means to the pixel image memory means; and position control means for positioning said selected pattern by storing the start address of the selected pattern, storing the start address of the rule line to be drawn in the pixel image memory means and causing the selected pattern to be moved into the pixel image memory means at sequential memory positions contiguous with the start address in memory.

* * * * *